US009050642B2

(12) United States Patent
Alberts et al.

(10) Patent No.: US 9,050,642 B2
(45) Date of Patent: Jun. 9, 2015

(54) METHOD AND APPARATUS FOR SURFACE ENHANCEMENT

(71) Applicant: Ormond, LLC, Auburn, WA (US)

(72) Inventors: Daniel G. Alberts, Renton, WA (US); Thomas J. Butler, Enumclaw, WA (US); Nicholas Cooksey, Seattle, WA (US); Daniel A. Woodward, Auburn, WA (US)

(73) Assignee: Ormond, LLC, Auburn, WA (US)

( * ) Notice: Subject to any disclaimer, the term of this patent is extended or adjusted under 35 U.S.C. 154(b) by 402 days.

(21) Appl. No.: 13/628,269

(22) Filed: Sep. 27, 2012

(65) Prior Publication Data

US 2013/0074561 A1 Mar. 28, 2013

Related U.S. Application Data

(60) Provisional application No. 61/539,888, filed on Sep. 27, 2011.

(51) Int. Cl.

| | |
|---|---|
| ***B21D 26/02*** | (2011.01) |
| ***C21D 7/04*** | (2006.01) |
| *C21D 9/00* | (2006.01) |

(52) U.S. Cl.

CPC *B21D 26/02* (2013.01); *C21D 7/04* (2013.01); *C21D 9/0018* (2013.01)

(58) Field of Classification Search

CPC ..... C21D 7/06; C21D 10/00; C21D 10/005; B24C 5/02; B24C 5/04; B24C 7/003; B24C 1/10; B21D 26/02; B08B 3/02; B05B 1/00

USPC ..... 72/53, 54; 29/90.7; 239/101, 102.1, 239/102.2, 601, 461–524

See application file for complete search history.

(56) References Cited

U.S. PATENT DOCUMENTS

| | | | | |
|---|---|---|---|---|
| 3,688,511 | A | 9/1972 | Harmstrof | |
| 3,834,200 | A | 9/1974 | Winter | |
| 4,172,974 | A | 10/1979 | Stingelin et al. | |
| 4,365,493 | A | 12/1982 | Feld et al. | |
| 4,772,304 | A | 9/1988 | Nakae et al. | |
| 5,048,316 | A * | 9/1991 | Thompson | 72/21.4 |

(Continued)

FOREIGN PATENT DOCUMENTS

WO 2007/124396 11/2007

OTHER PUBLICATIONS

H. K. Tonshoff, F. Kroos, C. Marzenell, "High-Pressure Water Peening—a New Mechanical Surface-Strengthening Process", Jan. 6, 1997, CIRP annals 46.1 pp. 113-116.*

*Primary Examiner* — Shelley Self
*Assistant Examiner* — Peter Iannuzzi
(74) *Attorney, Agent, or Firm* — Davis Wright Tremaine, LLP; George C. Rondeau, Jr.

(57) ABSTRACT

Systems and methods for generating beneficial residual stresses in a target material by generating cavitation shock waves through the use of a cavitation intensification conditioner. Shock waves emanate through the target material from collapsing cavitation voids in a liquid jet to generate residual stresses without significantly deforming the surface of the target material. A high pressure liquid is accelerated through a submerged peening nozzle to generate a high-speed liquid cavitating jet that is further intensified and controlled by use of the cavitation intensification conditioner.

33 Claims, 9 Drawing Sheets

(56) References Cited

U.S. PATENT DOCUMENTS

| | | | | |
|---|---|---|---|---|
| 5,086,974 | A | 2/1992 | Henshaw | |
| 5,117,366 | A | 5/1992 | Stong | |
| 5,305,361 | A | 4/1994 | Enomoto et al. | |
| 5,553,106 | A | 9/1996 | Enomoto et al. | |
| 5,584,016 | A | 12/1996 | Varghese et al. | |
| 5,704,824 | A | 1/1998 | Hashish et al. | |
| 5,749,384 | A | 5/1998 | Hayashi et al. | |
| 5,778,713 | A | 7/1998 | Butler et al. | |
| 5,897,062 | A | 4/1999 | Enomoto et al. | |
| 5,932,120 | A | 8/1999 | Mannava et al. | |
| 6,058,153 | A | 5/2000 | Kurosawa et al. | |
| 6,084,202 | A * | 7/2000 | Okazaki et al. | 219/121.61 |
| 6,153,023 | A | 11/2000 | Rokutanda | |
| 6,240,155 | B1 | 5/2001 | Kurosawa et al. | |
| 6,280,302 | B1 | 8/2001 | Hashish et al. | |
| 6,341,151 | B1 | 1/2002 | Enomoto et al. | |
| 6,345,083 | B1 | 2/2002 | Enomoto et al. | |
| 6,358,120 | B1 | 3/2002 | Poling et al. | |
| 6,425,276 | B1 | 7/2002 | Hirano et al. | |
| 6,464,567 | B2 | 10/2002 | Hashish et al. | |
| 6,502,442 | B2 | 1/2003 | Arola et al. | |
| 6,519,991 | B2 | 2/2003 | Hirano et al. | |
| 6,630,247 | B1 | 10/2003 | Fox et al. | |
| 6,639,962 | B2 * | 10/2003 | Enomoto et al. | 376/305 |
| 6,752,686 | B1 | 6/2004 | Hashish et al. | |
| 6,855,208 | B1 * | 2/2005 | Soyama | 134/16 |
| 6,945,859 | B2 | 9/2005 | Hashish et al. | |
| 6,981,906 | B2 | 1/2006 | Hashish et al. | |
| 7,276,824 | B2 | 10/2007 | Statnikov et al. | |
| 7,419,418 | B2 | 9/2008 | Alberts et al. | |
| 7,699,449 | B2 | 4/2010 | Yoshino et al. | |
| 7,716,961 | B2 | 5/2010 | Hatou et al. | |
| 7,720,190 | B2 | 5/2010 | Shimamura et al. | |
| 7,789,734 | B2 | 9/2010 | Swift et al. | |
| 7,884,924 | B2 | 2/2011 | Numata et al. | |
| 2002/0032498 | A1 | 3/2002 | Mattke et al. | |
| 2002/0079602 | A1 | 6/2002 | Pfeiffer | |
| 2003/0065424 | A1 | 4/2003 | Erichsen et al. | |
| 2003/0120375 | A1 | 6/2003 | Arai et al. | |
| 2003/0139041 | A1 | 7/2003 | LeClair | |
| 2003/0208296 | A1 | 11/2003 | Brisson et al. | |
| 2004/0004055 | A1 | 1/2004 | Barros | |
| 2004/0237713 | A1 | 12/2004 | Breslin et al. | |
| 2004/0245356 | A1 * | 12/2004 | Kondratiev et al. | 239/589 |
| 2004/0250584 | A1 * | 12/2004 | Offer | 72/56 |
| 2005/0103362 | A1 | 5/2005 | Soyama | |
| 2008/0130819 | A1 | 6/2008 | Ortega et al. | |
| 2009/0124169 | A1 | 5/2009 | Alberts et al. | |
| 2010/0242660 | A1 | 9/2010 | Offer et al. | |
| 2011/0005288 | A1 | 1/2011 | Matsui et al. | |
| 2011/0232348 | A1 | 9/2011 | Hatou et al. | |

* cited by examiner

METHOD AND APPARATUS FOR SURFACE ENHANCEMENT

CROSS REFERENCE TO RELATED APPLICATIONS

This application claims priority to U.S. Provisional Application No. 61/539,888, filed Sep. 27, 2011, entitled "Method and Apparatus for Surface Enhancement," which is hereby incorporated by reference in its entirety.

FIELD OF THE INVENTION

The present invention relates to generally to systems and methods of surface enhancement, and more particularly, to systems and methods of utilizing high pressure liquid jets that induce cavitation to perform one or a combination of surface enhancement processes on materials ("target materials").

BACKGROUND OF THE INVENTION

The following description includes information that may be useful in understanding the present invention. It is not an admission that any of the information provided herein is prior art or relevant to the presently claimed invention, or that any publication specifically or implicitly referenced is prior art.

The most common method of generating compressive residual stress in the surface of a material is shot peening, where small particles or balls (shot) are impacted against the target material to deform the surface. The shot is typically propelled with compressed air using automated equipment to move the peening nozzle over the surface of the part to be peened. The shot, frequently steel or ceramic, is usually accelerated to 50-100 m/s by the compressed air and strikes the surface with enough energy to deform the top layer of material beyond its elastic limit.

This plastically deformed surface induces residual compressive stresses in the material as the material underneath, which is not plastically deformed, tries to push the plastically deformed material back into its original volume. This "pushing" is the compressive stress that is a beneficial material property.

Variations on this method include striking the surface with particles spun off from a rotating wheel, low plasticity burnishing with a ball that is hydraulically pressed into the surface as it rolls across the part, and laser shock peening (LSP).

Cavitation peening is another method that involves shooting a high-pressure liquid jet against the target material in such a manner that cavitation bubbles collapse and shock waves pass into the material. Cavitation peening is generally performed with the liquid jet and the target material both submerged in a liquid. The shock waves generate compressive residual stresses in the target material similar to the other methods described above. However, cavitation peening has traditionally presented several shortcomings, such as limited stress depth, limited stress intensity and limited process rates, and has been known to cause damage to the surface of the peened material.

Examples of cleaning or stripping methods may include removal of scale, oxides, chrome coatings, thermal barrier coatings, or others. Examples of surface roughening applications include roughening metals or ceramics to create a desirable bonding surface geometry for coatings or bonding agents.

BRIEF DESCRIPTION OF THE DRAWINGS

Exemplary embodiments are illustrated in the referenced figures. It is intended that the embodiments and figures disclosed herein are to be considered illustrative rather than restrictive.

DESCRIPTION OF THE INVENTION

Figure 1:
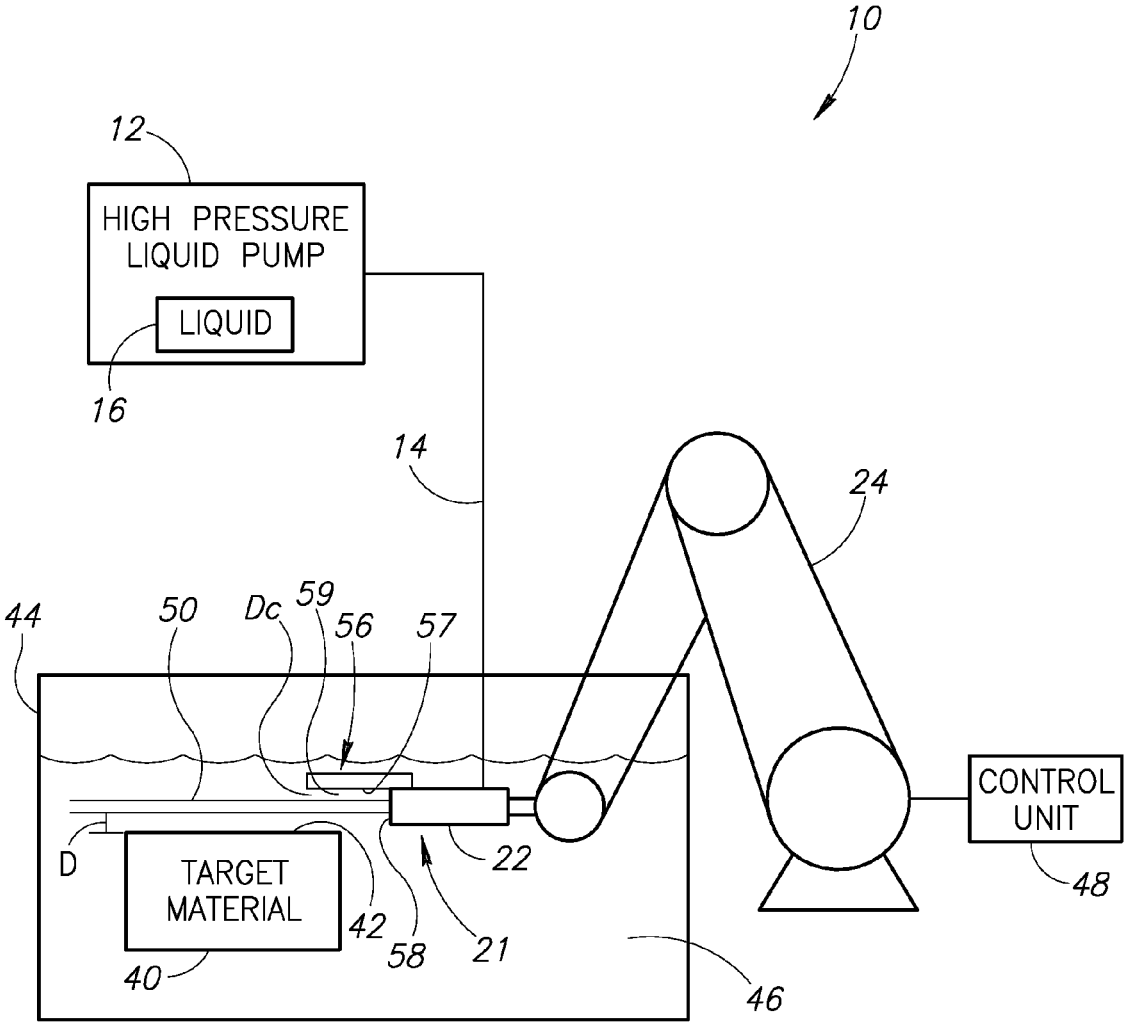
FIG. 1 illustrates a schematic diagram of a peening system according to an embodiment of the present invention.

One skilled in the art will recognize many methods, systems, and materials similar or equivalent to those described herein, which could be used in the practice of the present invention. Indeed, the present invention is in no way limited to the methods, systems, and materials described.

Methods of inducing residual compressive stresses in materials are desired in order to improve properties such as resistance to fatigue failure and stress corrosion cracking.

Further, methods are needed to clean, strip coatings from, or roughen surfaces in difficult applications. High-speed methods of performing the above-mentioned processes without damaging the processed target material are needed as an improvement over current methods.

The inventors of the present invention have recognized that all of the aforementioned methods have various shortcomings and limitations. Some or all of these shortcomings and limitations are remedied by the embodiments of the present invention discussed below. What follows is a discussion of some of the recognized shortcomings of past peening methods.

Conventional shot peening only produces relatively shallow compressive stresses, typically less than 0.25 mm deep. It also has the considerable drawback of roughening up the surface to be peened, thereby causing a limitation to the improvement in fatigue life.

Low plasticity burnishing is generally limited to accessible geometry that will provide access for the rolling ball and hydraulic actuators. Ultrasonic peening, such as described in U.S. Pat. No. 7,276,824, is faced with similar limitations.

Laser shock peening is comparatively slow and expensive. The equipment typically costs millions of dollars per station. The materials that can be processed using this method are limited, and this method is difficult to deploy under water. It is also difficult to apply laser peening to confined spaces, such as inside of small-diameter tubes or cavities.

Cavitation peening is lower cost than laser shock peening but has traditionally been more expensive than conventional peening, due in part to long process times. The residual stresses generated using cavitation peening can be deeper than conventional peening. U.S. Pat. No. 5,778,713 describes a cavitation peening method that shoots the liquid jet directly at the target material to perform peening. However, that invention is stated to be suitable for metal materials only and the direct impingement of the liquid jet requires utilization of a fine resolution raster pattern to cover the surface with the small jet footprint, requiring a significant amount of process time. The direct impingement method can also cause surface damage by erosion caused by the high velocity liquid jet that acts upon the surface of the material, thus limiting the available developed stress intensity. This is particularly true if the process time is long enough to provide the desired stress intensity and depth. U.S. Pat. No. 6,855,208 requires elevated ambient pressure to provide the desired performance.

U.S. Pat. No. 6,345,083 requires the use of an energy wasting deflecting element to peen along the side of the jet.

U.S. Pat. No. 5,305,361 utilizes an electrical vibrating transducer to induce cavitation.

Japanese Patent 06-047665 utilizes a large enclosing shroud to generate turbulence, which is stated to improved performance.

Conventional cleaning and coating removal methods often involve the undesired use of chemicals or destructive mechanical methods. Some of the above-mentioned references utilize cavitation and mention surface cleaning, however the required direct impingement of the high velocity liquid jets cause damage to the substrate material when tough coatings are to be removed due to erosion by the high velocity liquid jet. U.S. Pat. No. 5,086,974 is a direct impingement cavitating liquid jet. However, the energy level of the jet must be limited so as not to damage the processed material and the processing rate and performance is limited.

It should be noted that methods such as burnishing, laser shock peening, or lower pressure cavitation peening (which requires higher liquid flow rates) could be difficult or impossible to deploy in many applications due to the tool loading or support equipment that is required.

Embodiments of the present invention overcome many of these difficulties by utilizing a submerged pressurized liquid jet to perform cavitation peening. Illustrated embodiments of the current invention utilize a peening head design and operating parameters that significantly improve performance and process flexibility. Specifically, as discussed in further detail below, embodiments include a peening head having a cavitation intensification conditioner (or "conditioner") coupled thereto oriented substantially parallel to the cavitation or liquid jet. This conditioner acts to create a low-pressure region between the cavitation jet and the conditioner, thus increasing the cavitation intensity in and around the jet. This allows the use of cavitation for peening in a broader range of applications and at reduced cost and with improved results.

Embodiments of the present invention also support higher processing rates due to the increased cavitation intensity that they generate. The increased peening intensity allows higher processing rates because the systems and methods generate residual stresses of a given level faster than other cavitation peening methods and systems.

Further, embodiments of the present invention create more intense cavitation jets and make it possible to generate deeper and more intense residual stresses compared to other cavitation peening methods. Embodiments of the present invention have been shown to be capable of peening metals, as well as other materials such as ceramics, glass, composites, and plastics. Similarly, tougher coatings can be removed at high rates where past practices fail.

One of the benefits of the embodiments disclosed herein is that excellent results can be provided with the cavitation jet oriented at any angle relative to the surface of the material being peened (i.e., the "target material"). The jet can even be oriented parallel or tangent to a surface being peened without actually striking the surface with the jet, but still results in improved results over other cavitation peening methods. The benefit of this feature is that high residual stress magnitudes and depths can be obtained without damaging the surface of the target material.

FIG. 1 is a schematic block diagram of a cavitation or peening system 10 in accordance with an embodiment of the present invention. The system 10 comprises a high pressure liquid pump 12 that is provided to generate liquid pressures that are preferably between 15,000 psi to 200,000 psi, or higher. A rigid or flexible high-pressure liquid conduit 14 is provided to couple pressurized liquid 16 from the pump 12 to an input port of a peening head 21 comprising a liquid nozzle 22. The liquid 16 may comprise liquid water, cryogenic liquid, liquid rust inhibitor, or other suitable liquid. As an example, the pump 12 may be a KMT Waterjet Streamline V, a Flow International 20X pump, or another suitable pump.

The nozzle 22 (or a plurality of nozzles) is mounted to a robotic manipulator 24 configured to provide relative motion between the nozzle 22 and a target material 40 (e.g., the portion thereof to be processed). The nozzle 22 and the target material 40 are submerged in a tank 44 of liquid 46. The relative motion between the nozzle 22 and the target material 40 is designed such that a high-pressure liquid or cavitation jet 50 passes proximate to or in contact with a surface 42 of the target material 40 in areas that are desired to be processed. The robotic manipulator 24 may be coupled to a computer control unit 48 configured to preprogram and control the movement of the nozzle 22 in a plurality of dimensions and to control the starting and stopping of the process (e.g., by controlling the operation of the pump 12, etc.) using preprogrammed instructions.

Alternatively, the target material 40 may be mounted on the robotic manipulator 24 to provide the relative motion with the nozzle 22 being stationary. A further alternative is that both the nozzle 22 and the target material 40 are mounted on separate robotic manipulators 24 to provide the relative motion. Additionally, the nozzle 22 could also be held by a person and pointed at the surface 42 of the target material 40, wherein the operator manually moves the nozzle 22 to process a desired area of the material. As an example, the robotic manipulator 24 may be a Flying Bridge available from Flow International, Inc., a PAR Vector CNC, or other suitable robotic manipulator. An additional alternative is that, if only a small area is to be processed in one operation, processing may be performed with little or no relative motion between the nozzle 22 and the target material 40.

Another example of a robotic motion device is a remotely operated vehicle. The robotic motion device can be pre-programmed or may be operated manually to create the desired relative motion between the nozzle 22 and the material 40 so that a cavitation footprint 54 (see FIGS. 3A-3B) covers the area to be processed. There may also be tooling to hold the processed material 40 or to mount the robotic motion device 24.

Figure 7A:
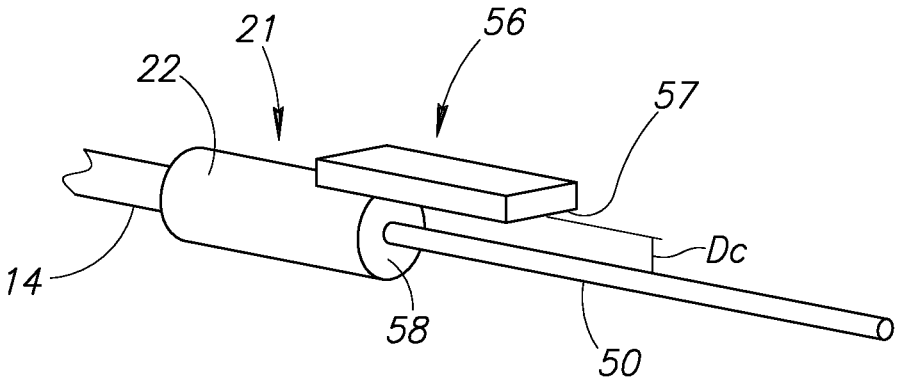
FIG. 7A illustrates a perspective view of the peening head and a cavitation intensification conditioner of the peening system of FIG. 1.
Figure 7B:
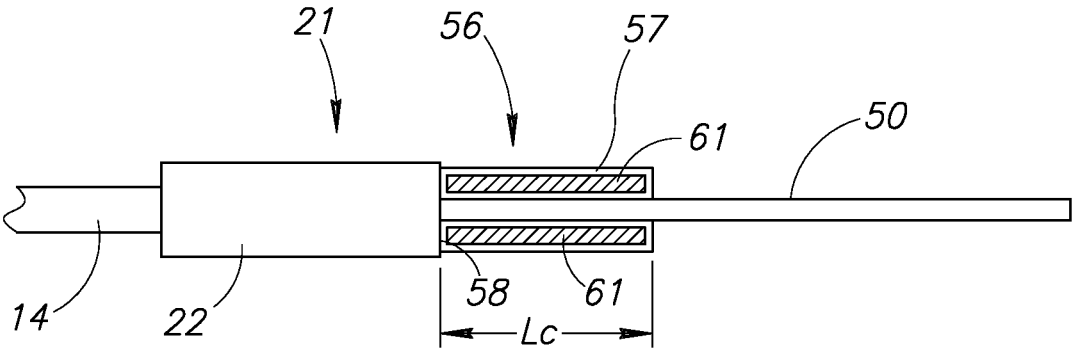
FIG. 7B illustrates a side view of the peening head and cavitation intensification conditioner shown in FIG. 7A.

As shown in FIGS. 1, 7A, and 7B, the peening head 21 includes a cavitation intensification conditioner 56 coupled to the nozzle 22 near a distal end 58 (or exit portion) thereof whereat the liquid exits the nozzle to produce a liquid or cavitation jet 50 and extending outwardly from the end 58 in a direction substantially parallel to the cavitation jet 50. The conditioner is adjacent to or "surrounds" at least a portion but not the entire circumference of the cavitation jet 50. The conditioner 56 acts to create a low-pressure region 59 between the jet 50 and a jet-facing surface 57 of the conditioner, thus increasing the cavitation intensity in and around the jet. The conditioner 56 is shaped to be substantially parallel to the jet 50 so that the conditioner guides the additional cavitation (or "cavitation cloud") toward the surface 42 of the target material 40 to enhance the cavitation peening process. Although the conditioner 56 is shown positioned on an opposite side of the jet 50 from the surface 42, the conditioner 56 may be oriented on any side of the jet 50 (e.g., between the jet and the surface 42 (FIG. 4), on a side of the jet, etc.).

Figure 8:
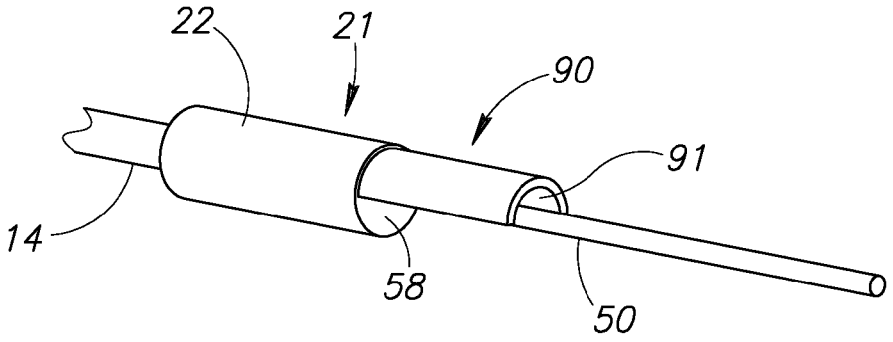
FIG. 8 illustrates a second embodiment of a cavitation intensification conditioner coupled to the peening head of the peening system of FIG. 1.
Figure 9:
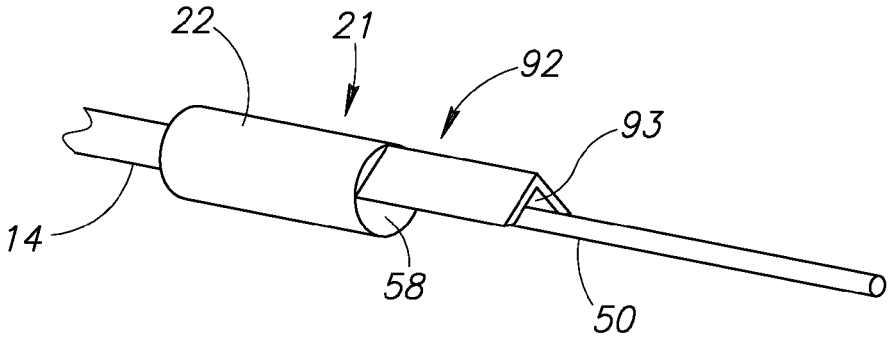
FIG. 9 illustrates a third embodiment of a cavitation intensification conditioner coupled to the peening head of the peening system of FIG. 1.
Figure 10:
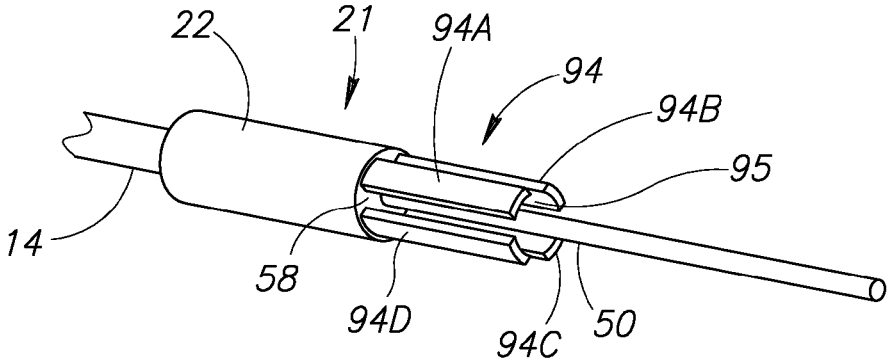
FIG. 10 illustrates a fourth embodiment of a cavitation intensification conditioner coupled to the peening head of the peening system of FIG. 1.

As shown in FIGS. 8, 9, and 10 (discussed below), the conditioner 56 may be designed using a range of shapes (see conditioners 90, 92, and 94). The finish of the jet-facing surface 57 of the conditioner 56 has an effect on the properties of the cavitation jet 50 and can be used to further improve performance. For example, the jet-facing surface 57 may include one or more enhancements 61 (see FIG. 7B). The enhancements 61 may be machined ridges, knurling, holes, slots, or other surface finish types. Depending on the specific application, the intensification conditioner 56 may be from 0.25 inches to 10 inches or longer in length $L_c$ (see FIG. 7B), measured from the distal end 58 of the nozzle 22. Generally, higher cavitation jet flow rates may utilize a longer intensification conditioner 56, but the length $L_c$ may also depend on ambient pressure, the desired results, etc. The conditioner 56 may be positioned at a distance $D_c$ from the jet 50 (see FIG. 1). The distance $D_c$ may be between approximately 0 inches (e.g., nearly touching the jet 50) to up to 2.00 inches (5.08 centimeters), with the distance $D_c$ often being related (e.g., proportional) to the flow rate of the jet 50.

Figure 2:
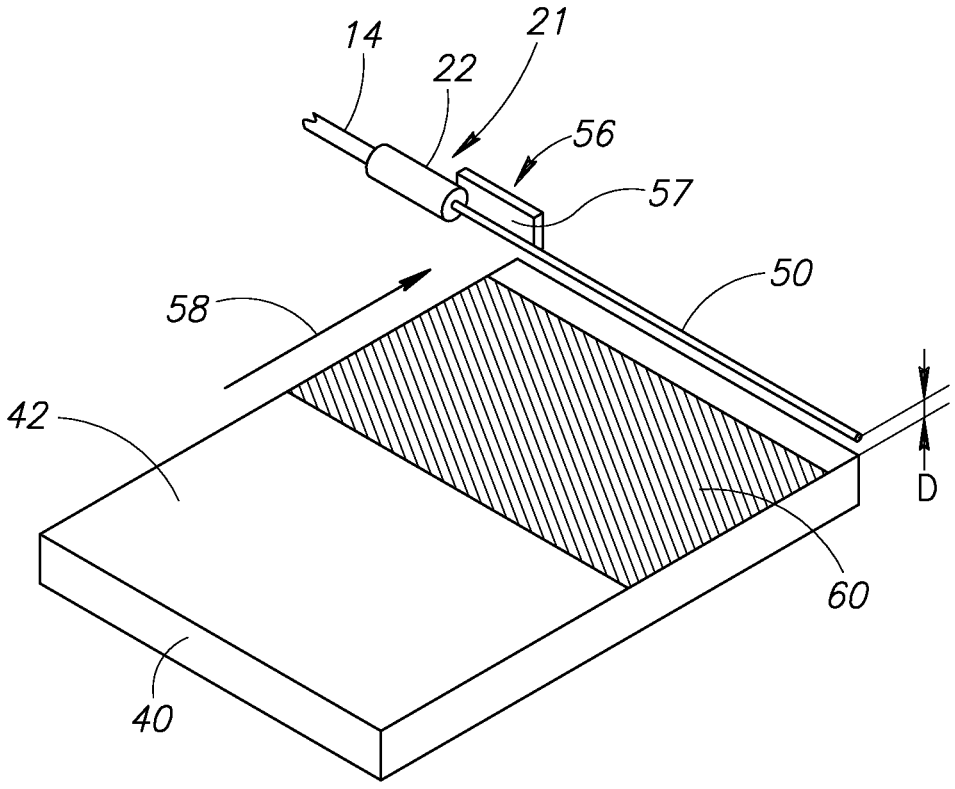
FIG. 2 is a perspective view illustrating a method of processing a target material using the peening system of FIG. 1 wherein a cavitation jet emitted from a peening head is oriented substantially parallel to the surface of the target material and does not strike the surface.

FIG. 2 illustrates a perspective view of the peening head 21 configured to direct the liquid jet 50 in a direction substantially parallel to the surface 42 of the material 40 at a stand-off distance D. In this example, the nozzle 22 moves in the direction of the arrow 58 creating a processed area 60 of the surface 42 of the material 40. In this example, the cavitation jet 50 is substantially parallel to the surface 42 of the material 40 and the jet is operated at a standoff distance D of approximately 0.010 inches (0.0254 cm) to 2.00 inches (5.08 centimeters) away from the surface of the material.

Figure 3A:
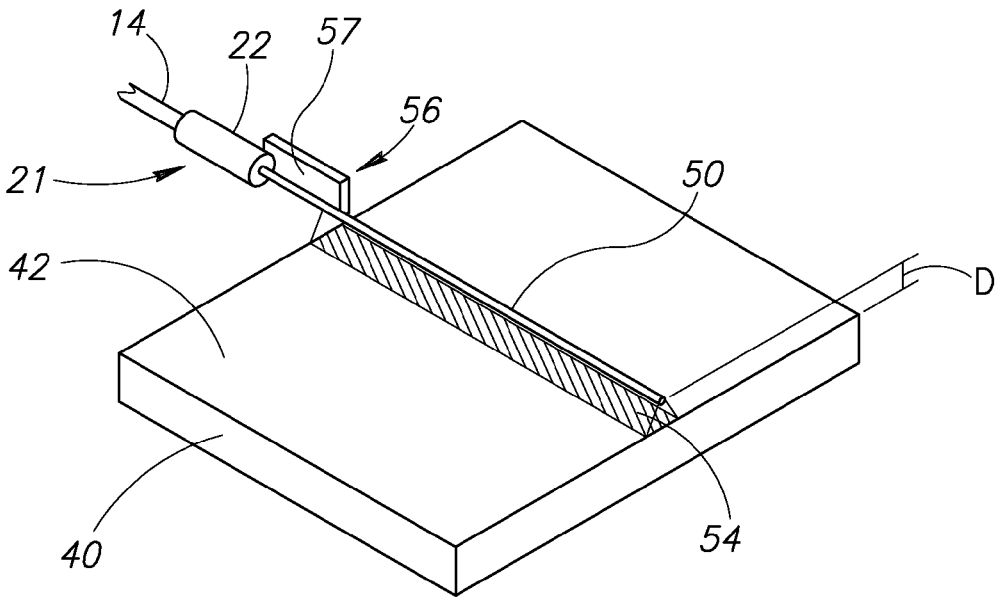
FIG. 3A is a perspective view of a footprint of the cavitation jet of the peening system on a surface of the target material.
Figure 3B:
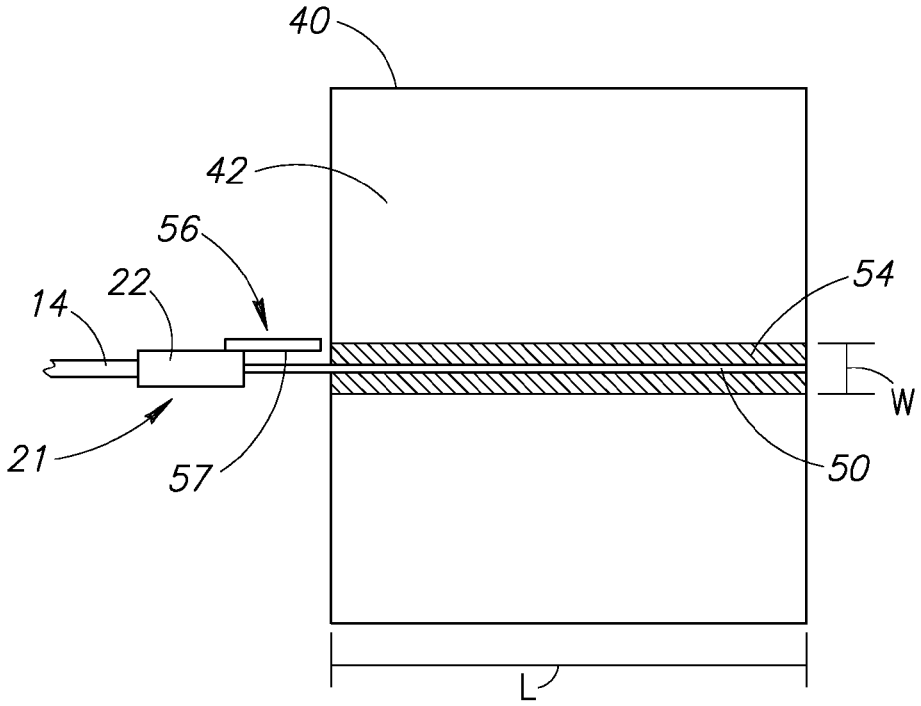
FIG. 3B illustrates a top view of the footprint of the cavitation jet of the peening system on the surface of the target material.

As shown in FIGS. 3A and 3B, embodiments of the present invention also support significantly higher processing rates due to the much larger cavitation footprint 54 on the surface 42 of the target material 40 and the higher power capacity when the jet 50 is substantially parallel to the surface 42 of the material 40. The parallel flow of the cavitation jet 50 over the surface 42 creates the elongated footprint 54 that has a width W that is greater than the cross-sectional diameter of the cavitation jet and a length L that corresponds to the portion of the cavitation jet that passes over the surface 42 with sufficient energy to process the surface. This is in contrast to a direct impingement cavitation jet footprint that will normally have a diameter of about 1 mm (e.g., approximately the cross-sectional diameter of the cavitation jet). The substantially parallel orientation of the cavitation jet 50 is can increase the processing rate by a factor of 100 times in many cases because the cavitation footprint 54 of the parallel oriented jet 50 can be 100 or more times the area of the diameter of the cavitation jet.

Figure 11:
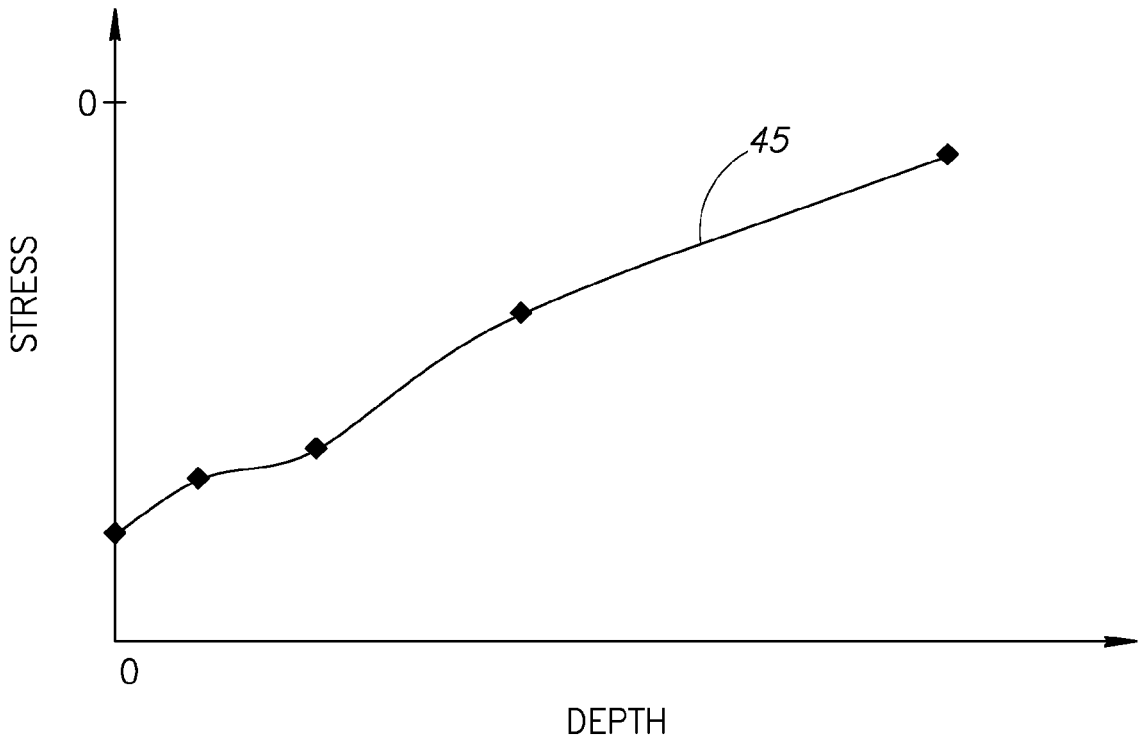
FIG. 11 illustrates a unit-less curve of residual stress vs. depth below the surface of the material that can be generated using the peening system of FIG. 1.

Further, the non-contact jet 50 allows the use of a higher pressure, higher velocity, more intense cavitation jet, without damaging the surface 42 by direct contact of the high velocity cavitation jet against the material 40. Because there is little danger of damaging the material 40, embodiments of the present invention allow intense cavitation peening and result in improved residual stress results compared to direct impingement peening. A unit-less example of a stress-depth curve 45 that can be generated using the peening system 10 is shown in FIG. 11. The methods disclosed herein are operative to peen metals as well as other materials such as ceramics, glass, composites, and plastics. Similarly, tougher coatings can be removed using the methods disclosed herein where past practice methods fail.

When roughening surfaces, embodiments of the invention utilizing the parallel oriented jet 50 may be used to provide extremely well controlled consistent finishes for the surface 42 because the finish is created by action of cavitation only and is not influenced by cavitation jet erosion. Because the cavitation jet 50 does not contact the surface 42, high-energy cavitation jets can be utilized without danger of erosion caused by the jets.

Embodiments of the present invention are easily deployed because the nozzle 22 can be small, lightweight, and in some embodiments (ultra-high pressure/low flow rate embodiments), the reaction load on the manipulator 24 or processed material 40 is relatively very low. One benefit of the invention is that the system 10 is operative to, with a single tool, perform one or a combination of processes including cleaning material surfaces, removing coatings from materials, roughening material surfaces, and/or generating beneficial compressive residual stresses or reducing tensile residual stresses in materials.

As discussed above, some embodiments of the present invention use the high-pressure cavitation jet 50 to generate cavitation that peens materials, thereby creating beneficial compressive residual stresses. The process relies on shock waves induced by cavitation bubbles collapsing on the surface 42 of the material 40 to be peened, instead of deformation of the surface. The process may be performed with the nozzle 22 and conditioner 56, cavitation jet 50, and the processed material 40 submerged in the tank 44 of liquid 46 (see FIG. 1). The liquid 46 in the tank may be, for example, water, oil, various liquids in solution with other liquids, liquids with dissolved solids added, or other liquids.

Figure 4:
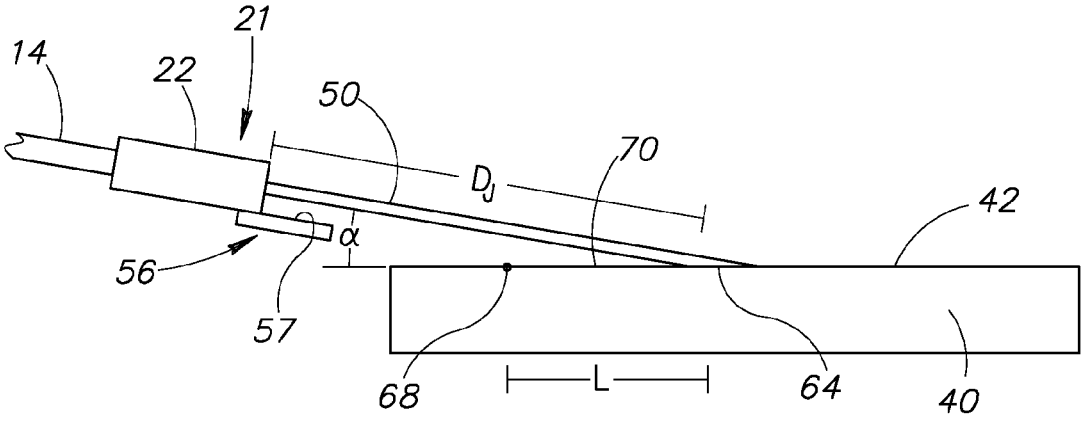
FIG. 4 illustrates a side elevational view of the peening system when directing a cavitation jet at the target material at a shallow angle.

As shown in FIG. 4, in some embodiments the nozzle 22 may be positioned to orient the cavitation jet 50 at a shallow angle α relative to the surface 42 of the material 40, rather than substantially parallel therewith. For example, the angle α may be approximately 0 degrees to 10 degrees. As will be appreciated, a higher flow rate jet 50 may be used if the jet is positioned farther away from the material 40.

Figure 5:
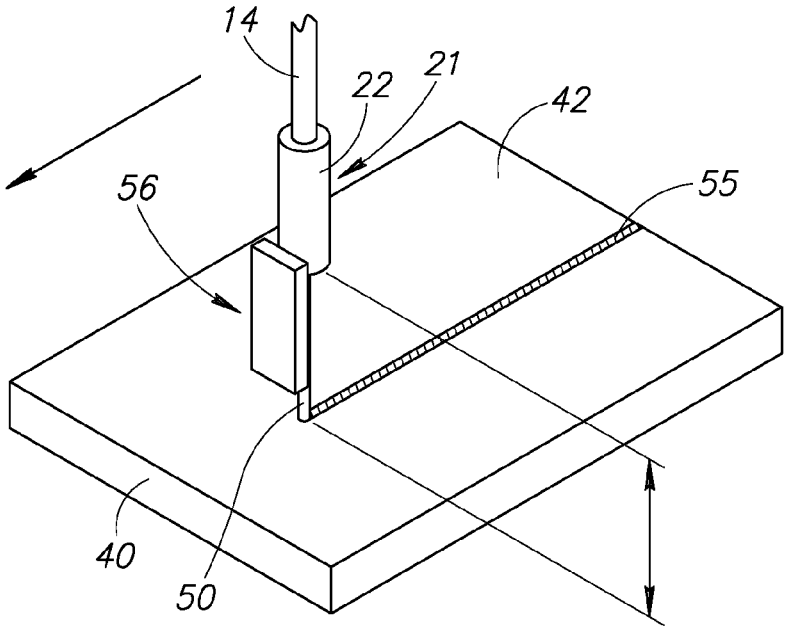
FIG. 5 is a perspective view illustrating a method of processing a target material using the peening system of FIG. 1 wherein the peening head is oriented such that a cavitation jet impinges the surface of the target material at a substantially right angle, or normal to the surface.

As shown in FIG. 5, in some embodiments the nozzle 22 may be positioned to orient the cavitation jet 50 at a substantially right angle relative to the surface 42 of the material.

Figure 6A:
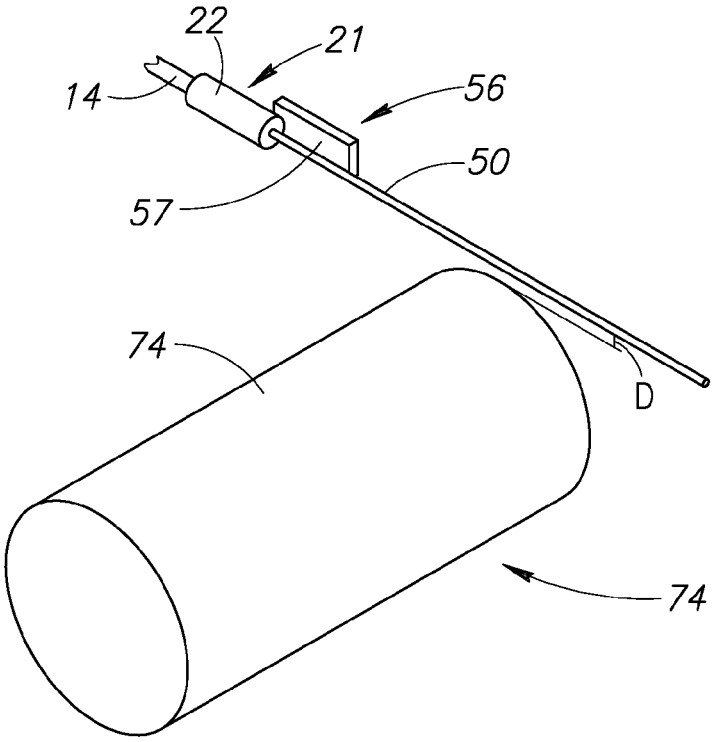
FIG. 6A illustrates a method of peening a cylindrically shaped target material by orienting a cavitation jet substantially tangent to a curved surface of the target material.
Figure 6B:
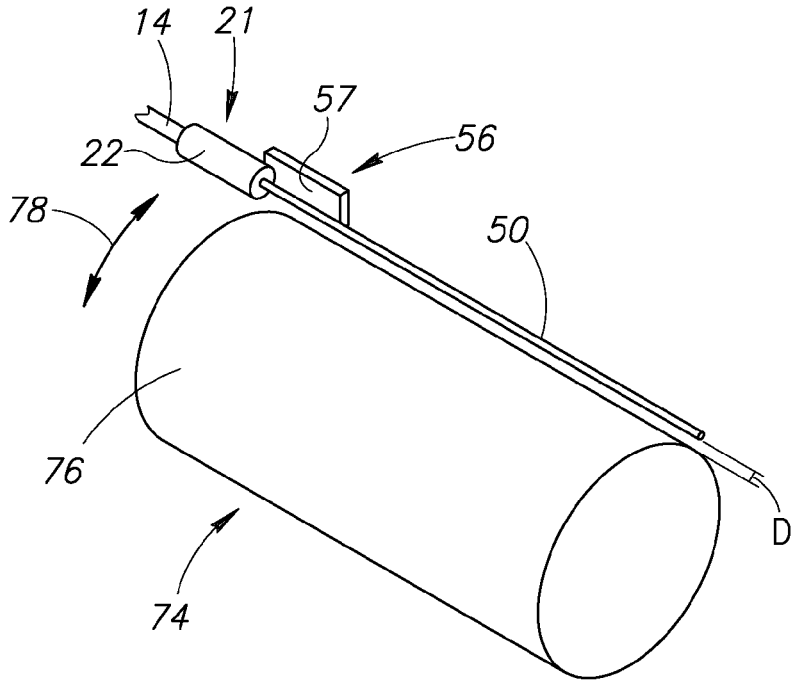
FIG. 6B illustrates a method of peening a cylindrically shaped target material by orienting a cavitation jet substantially along a longitudinal axis of the target material.

FIGS. 6A and 6B illustrate use of the system 10 to process an exterior curved surface 76 of a cylindrically shaped material 74. In FIG. 6A, the jet 50 is oriented substantially tangent to the curve of the surface 76. In FIG. 6B, the jet 50 is oriented substantially along a longitudinal axis of the cylindrically shaped material 74. As indicated by the arrow 78 in FIG. 6B, the nozzle 22 may rotate in a circular path to direct the jet 50 along the surface 76 of the material 74 offset from the surface 74, maintaining a standoff distance D throughout the rotation. It should be appreciated that the jet 50 may be also positioned at an angle to the longitudinal axis of the material 74 in other embodiments (see FIGS. 4 and 5). For irregular surfaces, in some embodiments the jet 50 may be oriented substantially parallel to the mean of the surface, or within substantially 10 degrees from the mean of the surface. This orientation maximizes the cavitation footprint of the jet 50 and maximizes the process rate, while preventing damage to the surface of the material caused by a direct impingement of a high-pressure cavitation jet.

If the jet 50 is oriented off-parallel to the surface 42 of the material 40 as shown in FIG. 4, the jet will strike the surface 42 at a contact point 64 at the angle α and flow over the surface 42. The particular footprint is dependent on the pressure, type of nozzle, type of liquid, orientation angle α, type of material 40, and other factors. When the jet 50 is oriented at an angle α to strike the surface 42 of the material 40, the distance from the nozzle 22 to the contact point 64 where the jet strikes the surface 42 may be referred to a jet distance $D_J$. The distance $D_J$ may be approximately 0.25 inches (0.635 cm) to 10 inches (25.4 cm) or more, depending on the application and jet flow rate. Generally, it has been found that the conditioner 56 is most effective when it is spaced apart from the target surface 42 by at least 0.25 inches (0.635 cm).

The nozzle 22 and jet 50 can be passed over the material 40 to cover large areas, or alternatively, can be operated momentarily at a stationary location over the material to process a limited area. In the latter case, the jet 50 can then be turned off and moved to another location and operated a multiple of times to provide the desired coverage.

This invention can be used on shapes ranging from simple flat or cylindrical materials, to complex shapes such as gears, turbines, or nuclear reactor core components.

Examples of liquids that may be used as the peening liquid 16 may include water, oil, liquid rust inhibitor, a solution of one liquid containing other liquid, or a solution of a liquid containing dissolved solids. The liquid 16 may be supplied to the nozzle 22 at pumped pressures of 15,000 to 200,000 psi, or higher. A non-limiting example nozzle 22 may have an orifice-opening diameter of between approximately 0.003 inches (0.00762 cm) and 0.25 inches (0.635 cm). The cavitation jet 50 can be operated when the surrounding liquid 46 (see FIG. 1) is at ambient atmospheric pressure or when the ambient pressure is elevated.

FIGS. 8, 9, and 10 illustrate three cavitation intensification conditioners 90, 92, and 94, respectfully, having differing shapes. It should be appreciated that the conditioners 90, 92, and 94 are shown as non-limiting examples of shapes for the conditioners. In each example, the conditioners 90, 92, and 94 are coupled to and extend outwardly from the distal end 58 of the nozzle 22 in a direction substantially parallel with the cavitation jet 50. The conditioners 90, 92, and 94 may be selectively or permanently coupled to the nozzle 22, or may be integrally formed therewith as a single component. Generally, the conditioners 90, 92, and 94 act to restrict the flow of liquid 46 (see FIG. 1) surrounding the jet 50 by an amount sufficient to create additional cavitation between the conditioners and the jet, but do not restrict the flow so much that additional cavitation does not occur. As an example, a cylindrical tube having a diameter that is slightly larger than the diameter of the jet 50 would most likely restrict the flow between the jet and an inner wall of the cylindrical by an amount such that increased cavitation would not occur. In addition to facilitating the production of additional cavitation, the conditioners 90, 92, and 94 also act as a guide to direct the intensified cavitation cloud toward the target surface 42 to increase the effectiveness of the peening process.

The conditioner 90 of FIG. 8 is formed in the shape of half a hollow cylinder. The conditioner 90 includes a jet-facing surface 91 positioned a predetermined distance from the cavitation jet 50. Since the conditioner 90 is disposed on only one side of the jet 50 and does not completely surround the jet, the flow of liquid around the jet is not overly restricted. As discussed above with reference to the cavitation conditioner 56, the finish of the jet-facing surface 91 of the conditioner 90 may include one or more enhancements (see the enhancements 61 on the surface 57 shown in FIG. 7B).

The conditioner 92 of FIG. 9 is formed in a shape having an inverted "V" or "chevron" cross-section. The conditioner 92 also has a jet-facing surface 93, which may in some embodiments include one or more enhancements.

The conditioner 94 of FIG. 10 is formed in the shape of a hollow cylinder having lengthwise apertures or through-slots that extend the entire length thereof. This is achieved by providing four spaced-apart, elongated projections 94A, 94B, 94C, and 94D having concave cross-sections and being disposed substantially concentrically around the cavitation jet 50. Each of the projections 94A-D includes a jet-facing surface 95, which may in some embodiments include one or more enhancements. The gaps between each of the projections 94A-94D allow for sufficient liquid to flow between the jet 50 and the surfaces 95 to facilitate intensified cavitation. The projections 94A-D extend substantially parallel to the jet 50 so that the additional cavitation is directed toward the surface 42 of the target material 40.

Figure 12:
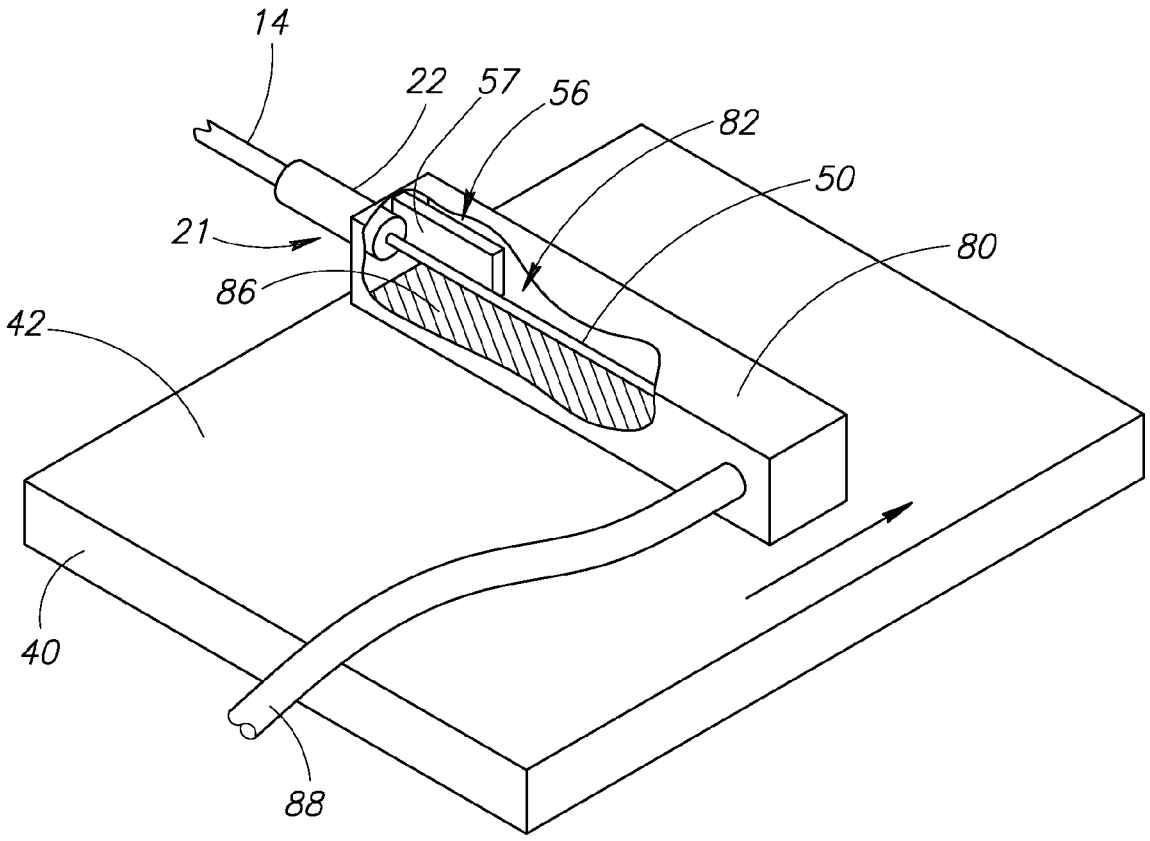
FIG. 12 is a perspective view illustrating a method of processing a target material using the peening system of FIG. 1 wherein a cavitation jet is oriented substantially parallel to the surface of the target material and does not strike the surface and the jet and target material are submerged in a liquid within a shroud.

FIG. 12 is a perspective view illustrating a method of processing the target material 40 using the peening system 10 of FIG. 1 wherein the cavitation jet 50 is oriented parallel to the surface 42 of the target material and does not strike the surface. In this embodiment, the nozzle 22 is coupled to a shroud 80 having an interior portion 82 configured for receiving a liquid (not shown for clarity) from a liquid conduit 88 coupled to the shroud. The shroud 80 is open at the bottom exposing a shrouded portion 86 of the surface 42 of the material 40 to the liquid. Thus, the jet 50 and at least a portion of the shrouded portion 86 of the target material 40 are submerged in a liquid. In operation, the nozzle 22 and shroud 80 may be moved over the surface 42 to process the material 40 as desired. This method may be beneficial in applications where it is not feasible to submerge the entire target material 40 into the liquid tank 44.

Other peening methods rely on the use of elevated ambient pressure in the liquid surrounding the cavitation jet and target material. Embodiments of the present invention reduce the requirement to pressurize the surrounding liquid bath, depending on the application. This is a benefit over other cavitation peening methods because it simplifies the cost and complexity of the equipment needed to perform the process. This is because in some embodiments, a pressure vessel that peening would otherwise need to be performed within is either not needed, or at least a pressure vessel with reduced pressure rating requirements may be used. Further, generally it is not feasible to peen many large components inside of a pressure vessel due to cost.

In applications where an elevated ambient pressure is inherent, such as in nuclear reactor vessels, the elevated ambient pressure does nothing to damage performance, but can increase performance somewhat. Embodiments of the present invention make changes in water depth (and therefore ambient pressure) while performing cavitation peening much less of an impediment on the process. In other words, the process performance does not change as parts are peened at different water depths (e.g., in a submerged reactor vessel).

Because the conditioners disclosed herein can generate more intense cavitation, when desired they can be used to generate roughened surfaces faster than conventional methods. When roughening surfaces at shallow impingement angles (see FIG. 4), or without striking the surface with the jet (see FIG. 2), embodiments may be used to provide extremely well-controlled, consistent finishes because the finishes are created by action of cavitation only and are not influenced by cavitation jet erosion.

While not required, an option that may improve residual stress magnitude and depth in some applications using precipitation hardening stainless steels or other heat treatable materials is to peen before heat-treating, and again after heat treating. This is beneficial in materials that are not stress relieved during a heat treatment process, such as PH15-5 or Custom 465 stainless steel. Peening before heat treatment (or otherwise termed "aging") provides good depth penetration because of the low strength of the target material. The magnitude of the residual may be, however, limited due to the low yield strength of the material. Peening again after heat treatment may provide increased residual stress magnitude due to the increased yield strength after the heat treatment.

The foregoing described embodiments depict different components contained within, or connected with, different other components. It is to be understood that such depicted architectures are merely exemplary, and that in fact many other architectures can be implemented which achieve the same functionality. In a conceptual sense, any arrangement of components to achieve the same functionality is effectively "associated" such that the desired functionality is achieved. Hence, any two components herein combined to achieve a particular functionality can be seen as "associated with" each other such that the desired functionality is achieved, irrespective of architectures or intermedial components. Likewise, any two components so associated can also be viewed as being "operably connected," or "operably coupled," to each other to achieve the desired functionality.

While particular embodiments of the present invention have been shown and described, it will be obvious to those skilled in the art that, based upon the teachings herein, changes and modifications may be made without departing from this invention and its broader aspects and, therefore, the appended claims are to encompass within their scope all such changes and modifications as are within the true spirit and scope of this invention. Furthermore, it is to be understood that the invention is solely defined by the appended claims. It will be understood by those within the art that, in general, terms used herein, and especially in the appended claims (e.g., bodies of the appended claims) are generally intended as "open" terms (e.g., the term "including" should be interpreted as "including but not limited to," the term "having" should be interpreted as "having at least," the term "includes" should be interpreted as "includes but is not limited to," etc.).

It will be further understood by those within the art that if a specific number of an introduced claim recitation is intended, such an intent will be explicitly recited in the claim, and in the absence of such recitation no such intent is present. For example, as an aid to understanding, the following appended claims may contain usage of the introductory phrases "at least one" and "one or more" to introduce claim recitations. However, the use of such phrases should not be construed to imply that the introduction of a claim recitation by the indefinite articles "a" or "an" limits any particular claim containing such introduced claim recitation to inventions containing only one such recitation, even when the same claim includes the introductory phrases "one or more" or "at least one" and indefinite articles such as "a" or "an" (e.g., "a" and/or "an" should typically be interpreted to mean "at least one" or "one or more"); the same holds true for the use of definite articles used to introduce claim recitations. In addition, even if a specific number of an introduced claim recitation is explicitly recited, those skilled in the art will recognize that such recitation should typically be interpreted to mean at least the recited number (e.g., the bare recitation of "two recitations," without other modifiers, typically means at least two recitations, or two or more recitations).

What is claimed is:

1. A peening system for cavitation peening a target surface of a target material, the peening system comprising:

a liquid pump configured for pressurizing a liquid; and a peening head comprising:

a liquid input port coupleable with the liquid pump configured for receiving the pressurized liquid from the liquid pump;

a liquid nozzle coupled to the liquid input port and configured for accelerating the pressurized liquid into a high velocity liquid jet that exits from an exit portion of the liquid nozzle in a first exit direction; and a cavitation intensification conditioner extending outwardly from the exit portion of the liquid nozzle in a direction substantially parallel to the first exit direction of the liquid jet, the cavitation intensification conditioner configured to surround a portion but not all of the circumference of the liquid jet exiting from the exit portion of the liquid nozzle and the cavitation intensification conditioner having an exit portion from which the liquid jet exits in a second exit direction substantially parallel to the first exit direction of the liquid jet.

2. The peening system of claim 1, wherein the cavitation intensification conditioner is coupled to the liquid nozzle for movement therewith.

3. The peening system of claim 1, wherein the cavitation intensification conditioner comprises one or more surface enhancements facing toward the liquid jet configured to increase cavitation as the liquid jet exits from the exit portion.

4. The peening system of claim 3, wherein the one or more surface enhancements comprise ridges, knurling, holes, or slots.

5. The peening system of claim 1, wherein the cavitation intensification conditioner extends outwardly from the exit portion of the liquid nozzle by a distance of between 0.25 inches and 10 inches.

6. The peening system of claim 1, wherein the cavitation intensification conditioner is configured to surround less than one-half of the circumference of the liquid jet.

7. The peening system of claim 1, wherein the cavitation intensification conditioner comprises a plurality of elongated members extending outwardly from the exit portion of the liquid nozzle.

8. The peening system of claim 1, further comprising a robotic manipulator coupled to at least one of the peening head and the target material, and configured to selectively provide relative motion between the peening head and the target material.

9. The peening system of claim 8, further comprising a computer control unit operative to selectively control the movement of the robotic manipulator according to pre-programmed instructions.

10. The peening system of claim 1, wherein the liquid pump is configured to pressurize the liquid to a pressure greater than 15,000 pounds per square inch (PSI).

11. The peening system of claim 1, further comprising a robotic manipulator coupled to at least one of the peening head and the target material, and configured to selectively provide relative motion between the peening head and the target material, wherein the robotic manipulator is configured to maintain a distance between the cavitation intensification conditioner and the target surface of between 0.125 inches and 15 inches.

12. The peening system of claim 1, further comprising a tank for containing a liquid therein, and sized to permit the peening head and the target material to be submerged in the liquid during a peening process.

13. The peening system of claim 12, wherein the liquid is placed inside the tank and comprises one of water and oil.

14. The peening system of claim 1, further comprising a shroud coupled to the peening head and configured to provide a liquid environment for the high velocity liquid jet and the target surface of the target material.

15. The peening system of claim 1, wherein the liquid nozzle comprises an exit orifice having a diameter of between 0.003 inches and 0.25 inches.

16. The peening system of claim 1, wherein the exit portion of the liquid nozzle is a distal end thereof.

17. A peening system for increasing residual stresses in a target material, the peening system comprising:

a tank containing a first liquid;

a liquid pump configured for pressurizing a second liquid to a pressure of at least 15,000 pounds per square inch (PSI); and a peening head submerged in the first liquid inside the tank, the peening head comprising:

a liquid input port coupleable with the liquid pump configured for receiving the second liquid from the liquid pump;

a liquid nozzle coupled to the liquid input port and configured for accelerating the second liquid into a high velocity liquid jet exiting from an exit portion of the liquid nozzle; and a cavitation intensification conditioner extending outwardly from the exit portion of the liquid nozzle in a direction substantially parallel to the liquid jet, the cavitation intensification conditioner positioned proximate to the liquid jet for a length thereof and laterally separated therefrom by a distance of between 0.01 inches and 2 inches, the cavitation intensification conditioner having an exit portion from which the liquid jet exits in a substantially same direction as the liquid jet exits from the exit portion of the liquid nozzle.

18. The peening system of claim 17, wherein the cavitation intensification conditioner comprises a jet-facing surface comprising one or more surface enhancements configured to increase cavitation.

19. The peening system of claim 18, wherein the one or more surface enhancements comprise ridges, knurling, holes, or slots.

20. The peening system of claim 17, wherein the cavitation intensification conditioner extends outwardly from the exit portion of the liquid nozzle by a distance of between 0.25 inches and 10 inches.

21. The peening system of claim 17, wherein the cavitation intensification conditioner surrounds approximately one-half of the circumference of the liquid jet.

22. The peening system of claim 17, wherein the cavitation intensification conditioner comprises one or more elongated members extending outwardly from the exit portion of the liquid nozzle.

23. A method of peening a target surface of a target material, the method comprising:

providing a volume of a first liquid;

pressurizing a second liquid;

forming a high velocity liquid jet from the pressurized second liquid;

directing the high velocity liquid jet through the first liquid in a direction toward the target surface of the target material;

conditioning the high velocity liquid jet by utilizing a cavitation intensification conditioner positioned substantially adjacent to a length of the high velocity liquid jet to increase cavitation without obstructing the liquid jet; and directing the increased cavitation toward the target surface of the target material.

24. The method of claim 23, wherein the cavitation intensification conditioner comprises a jet-facing surface comprising one or more surface enhancements configured to increase cavitation.

25. The method of claim 24, wherein the one or more surface enhancements comprise ridges, knurling, holes, or slots.

26. The method of claim 23, wherein the cavitation intensification conditioner comprises one or more elongated members extending outwardly from a portion of a liquid nozzle from which the high velocity liquid jet exits.

27. The method of claim 23, where the second liquid comprises liquid water.

28. The method of claim 23, where the second liquid comprises liquid rust inhibitor.

29. The method of claim 23, where the second liquid comprises liquid oil.

30. The method of claim 23, where the second liquid comprises liquid water containing dissolved solids.

31. The method of claim 23, wherein pressurizing the second liquid comprises raising the pressure of the second liquid to a pressure greater than 15,000 pounds per square inch (PSI).

32. A method of peening a target surface of a target material, the method comprising:

providing a liquid nozzle operative to generate a high velocity liquid jet of a first liquid, the liquid nozzle having an elongated cavitation intensification conditioner extending from a portion thereof where the liquid jet exits the liquid nozzle in a direction parallel to the direction of flow of the liquid jet and substantially adjacent thereto for a length of the liquid jet without obstructing the liquid jet, the cavitation intensification conditioner generating increased cavitation as the liquid jet passes in proximity therewith in a second liquid;

submerging the liquid nozzle in the second liquid; and operating the liquid nozzle to direct the liquid jet toward the target surface of the target material.

33. The method of claim 32, further comprising placing the elongated cavitation intensification conditioner less than 2 inches from the liquid jet over the length of the liquid jet.

* * * * *